United States Patent [19]

Larsson et al.

[11] 4,382,903

[45] May 10, 1983

[54] METHOD FOR MANUFACTURING A METAL POWDER BY GRANULATION OF A METAL MELT

[75] Inventors: Hans G. Larsson; Erik Westman, both of Västeras, Sweden

[73] Assignee: ASEA Aktiebolag, Västeras, Sweden

[21] Appl. No.: 237,370

[22] Filed: Feb. 23, 1981

Related U.S. Application Data

[63] Continuation-in-part of Ser. No. 58,766, Jul. 19, 1979, abandoned.

[51] Int. Cl.[3] ..... B01J 2/04

[52] U.S. Cl. ..... 264/12; 264/13; 264/14

[58] Field of Search ..... 264/12, 13, 14

[56] References Cited

U.S. PATENT DOCUMENTS 2,308,584 1/1943 Best ..... 264/12
3,150,947 9/1964 Bland ..... 264/12
4,113,456 9/1978 Levecque et al. ..... 264/12
4,124,377 11/1978 Larson ..... 264/12

*Primary Examiner*—James R. Hall
*Attorney, Agent, or Firm*—Watson, Cole, Grindle & Watson

[57] ABSTRACT

A method for granulating a metal melt wherein a tap stream of molten metal is granulated by directing a jet of gas having a trough-shaped cross-section against the side of the tap stream such that the tap stream is formed into droplets which are thrown into a parabolic trajectory. An additional gas jet is also directed towards the tap stream so that it hits both the trough-shaped gas jet and the tap stream, the additional gas jet acting to prevent the droplets of metal melt from moving towards the nozzle from which the trough-shaped jet of gas emanates. The nozzle which emits the trough-shaped jet of gas can thus be positioned very closely to the side of the tap stream without becoming clogged with deposited droplets of metal melt.

13 Claims, 10 Drawing Figures

METHOD FOR MANUFACTURING A METAL POWDER BY GRANULATION OF A METAL MELT

CROSS-REFERENCE TO RELATED APPLICATION

The present application is a continuation-in-part application of application Ser. No. 058,766, 1 filed July 19, 1979, now abandoned.

BACKGROUND OF THE INVENTION

The present invention is directed to a method of forming metal powders, and more specifically to a method of forming metal powders by first blowing a gas jet into a vertically descending stream of molten metal to produce metal droplets therefrom and then rapidly cooling the produced metal droplets so as to form solidified metal grains.

Metal powders having uniform characteristics find wide uses in industry, and for example are commonly used to manufacture compacted bodies using hot isostatic pressing techniques. These metal powders, however, can be difficult to produce by conventional casting methods because when the metals are, for example, steels containing a high content of alloying materials, segregation, deterioration of the structure due to grain growth, etc., will detrimentally occur with the slow solidification of the metals during the casting techniques.

On the other hand, methods of producing metal powders by techniques other than casting have long been used, these methods producing powders which will display improved properties. For example, it is known to form metal powders having uniform characteristics by blowing a gas jet into the side of a vertically descending stream of molten metal to produce a spray of metal droplets and then rapidly cooling the droplets to form the metal powders. Such methods have been conducted using gas jets having generally trough-shaped cross sections so as to enhance the production of the metal droplets (see U.S. Pat. No. 1,245,328) or with specifically V-shaped (with non-converging sides) cross sections to help reduce droplet spattering onto the face of the nozzle from which it emanates (see U.S. Pat. No. 2,308,584).

However, all of these prior art techniques of metal powder production consume large quantities of energy for their operation, and some of them not only must be conducted in enclosures having great vertical dimensions, but they do not always produce powders which are small, uniform in size and uniform in composition.

It is an object of the present invention to provide a method of producing metal powders wherein the produced powder particles will be small, uniform in size and uniform in composition.

It is a further object of the present invention to provide a method of producing metal powders using the technique of blowing a jet of gas into the side of a vertically descending stream of molten metal so as to form metal droplets therefrom and then rapidly cooling the formed droplets as they travel in a parabolic trajectory away from the original path of the molten stream, wherein the metallic droplets will be positively prevented from eddying towards the face of the nozzle from which the gas jet flows and wherein the energy consumption of the method will be greatly reduced.

SUMMARY OF THE PRESENT INVENTION

According to the present invention, one or more trough-shaped jets of gas are blown into the side of a vertically descending, generally symmetrical stream of molten metal (tap stream) so as to form metal droplets therefrom and cause them to travel in a parabolic trajectory away from the original path of the molten stream and be rapidly cooled, and at the same time an auxiliary gas jet is utilized in association with each trough-shaped gas jet to blow gas downwardly into the open area of the trough-shaped gas jet adjacent its point of contact with the molten metal stream to positively prevent molten metal droplets from moving towards the nozzle face from which the associated trough-shaped gas jet emanates. Thus the face of the nozzle from which the trough-shaped gas jet flows can be successfully located extremely closely to the side of the tap stream without the worry of nozzle clogging, and as a result the amount of energy needed to pressurize the gas entering the nozzle to give it a great enough velocity upon issuance from the nozzle face that it can pass through the distance between the nozzle face and the side of the tap stream and still retain sufficient velocity to thoroughly shatter the tap stream into uniformly sized droplets will be greatly reduced.

Each of the trough-shaped gas jets is preferably directed towards the vertically descending stream of molten metal such that its vertical plane of symmetry will be aligned with the vertical center line of the stream. The angle at which each gas jet will be directed will vary, e.g., it may be at 90° to the vertical center line of the tap stream (i.e. directed horizontally) or it may be angled at between 45° and 135° with respect to this vertical line. Preferably, the angle of gas flow will be between 60° and 100°.

Each of the auxiliary gas jets will itself be directed obliquely downwardly towards the direction of flow of the associated trough-shaped gas jet. Each auxiliary gas jet will be advantageously directed so that at least a portion of it will impact with the molten metal stream just ahead of the point of impact of the bottom portion of the associated trough-shaped gas jet, thereby causing a slight flattening of the metal stream just prior to its being contacted by the associated trough-shaped gas jet. This results in a reduction in the number of undesirably coarse metal powder grains produced by the overall method.

Each trough-shaped gas jet and associated auxiliary gas jet can be caused to have differing velocities to control the trajectories of the produced metal droplets, the velocities being controlled by the pressures on the gases supplied to the nozzles from which they emanate.

Further objects, advantages and features of the present invention will become more fully apparent from a detailed consideration of the accompanying drawings taken in conjunction with the following further discussion.

DETAILED DESCRIPTION OF THE PREFERRED EMBODIMENTS

Figure 1:
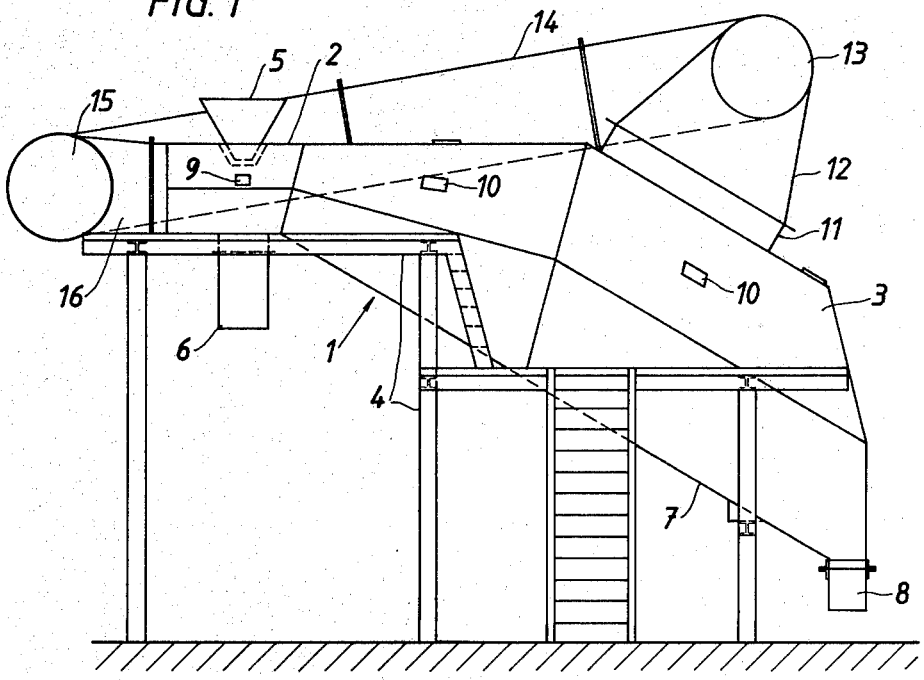
FIG. 1 shows a schematic side view of a granulating apparatus which can be utilized to achieve the method of the present invention.

As shown in FIG. 1, an apparatus which can be used to conduct the method of the present invention can comprise a closed housing 1 which includes a granulating section 2 and a collecting section 3, the metal powder being initially produced in section 2 and then passing along a parabolic path as indicated by arrow 100 into the section 3 where they are collected. The housing 1 is elevated and supported by structure 4.

The granulating section 2 includes a casting box 5 and a ladle 6 (located below box 5), the ladel 6 operating to collect the metal melt descending from casting box 5 during disturbances in the operation of the apparatus or during its start up (when the downwardly descending metal melt may contain particularly large amounts of impurities). Lower wall 7 of the collecting section 3 inclines downwardly, the angle of inclination being greater than the natural angle of repose of the formed metal powder. The metal powder produced in the apparatus is collected in container 8 at the bottom of section 3.

The granulating section 2 of the housing 1 also includes an inspection window 9 in one side wall positioned to view the area below the casting box 5, while section 3 includes inspection windows 10 in one side wall. An outlet opening is located in the upper wall of the section 3 and a cooler 11 is positioned above this outlet opening for cooling the used gas (which has been heated during the granulation process) which flows therethrough from section 3. A portion of the cooled gas is returned via ducts 12, 13, 14, 15 and 16 to the granulating section 2, whereas the remaining portion is sucked through a cleaning filter (not shown) to a compressor (not shown) which supplies the needed gas to the granulating nozzles 19, 20 located in section 2.

Figure 2:
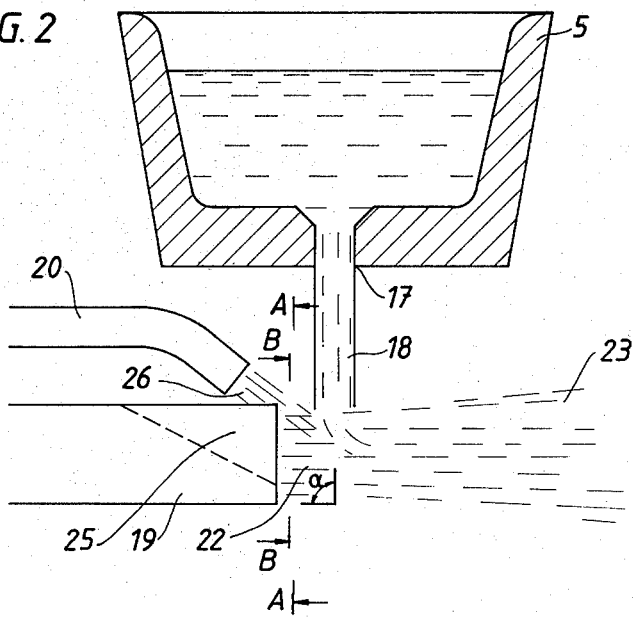
FIG. 2 shows an enlarged schematic side view of the part of the apparatus in FIG. 1 which produces the metal droplets from a vertically descending molten metal stream according to the present invention, this part including one embodiment of a primary nozzle for emitting a trough-shaped gas jet and one embodiment of a secondary nozzle for emitting an associated auxiliary gas jet.
Figure 3:
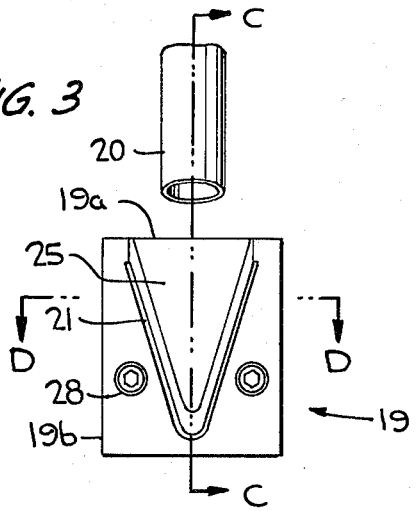
FIG. 3 shows a view of the nozzles shown in FIG. 2 when viewed along line A—A.

As shown in FIG. 2, the casting box 5 includes a tap opening 17 through which the molten metal therein will flow to form a vertically downwardly descending tap stream 18 having a vertical center line 18*a*. Positioned closely along the side of this stream is a primary nozzle 19 and a secondary nozzle 20. As seen in FIG. 3, primary nozzle 19 has a face which includes a V-shaped discharge orifice 21, whereas secondary nozzle 20 has a circular discharge orifice. The angle between the upwardly extending portions of the V-shaped gas jet may be between 15° and 60°. The secondary nozzle 20, which is oriented to discharge an auxiliary gas jet 26 (see FIG. 2) in the same general direction as the V-shaped gas jet 22 issuing from the primary nozzle 19, is angled downwardly as shown in FIG. 4 such that angle $\beta$ between the direction 26*a* of the flow of gas jet 26 and a line L parallel with the vertical center line 18*a* of the tap stream 18 is about 20°–30°.

The V-shaped gas jet 22 (see FIG. 2) which emanates from the primary nozzle 19 contacts the molten metal (tap) stream and breaks it up into droplets which are then rapidly cooled by the cool gases flowing through duct 16 to form metal powder particles, and these powder particles are concurrently thrown in a parabolic trajectory into section 3. The angle $\alpha$ between the direction 22*a* of flow of the V-shaped gas jet 22 and the vertical center line 18*a* of the tap stream 18 may be between about 45° and 135°, and preferably will be between about 60° to 100°.

Figure 10:
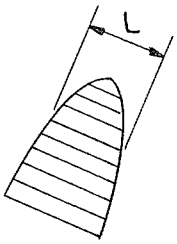
FIG. 10 shows a view taken along line E—E of FIG. 6, depicting the contact area between the trough-shaped gas jet and the tap stream.

Since the gas jet 22 is V-shaped, as indicated in FIG. 10 two semi-elliptical intersecting surfaces are obtained when it hits tap stream 18. The V-shaped gas jet 22 will then acquire a large effective width and therefore will have a good ability to break up top stream 18 into small, uniformly sized droplets. The nozzles 19 and 20 will be located sufficiently close to the side of tap stream 18 that a portion of the auxiliary gas jet 26 will hit the side of the tap stream 18.

Figure 4:
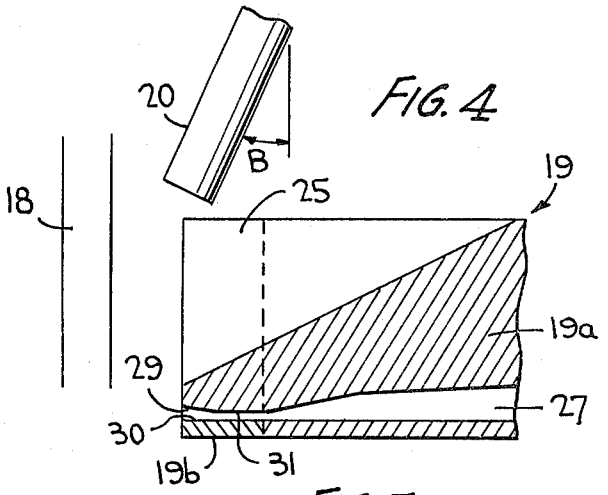
FIG. 4 shows a sectional view of portions of the nozzles shown in FIG. 2, as well as their relationship to a vertically descending molten metal stream, when viewed along line C—C of FIG. 3.

As is shown in FIGS. 3 and 4, primary nozzle 19 which forms V-shaped gas jet 22 may, for example, be composed of a first member 19*a* having supply channel 27 for gas and a second member 19*b* which is joined to the first member by bolts 28. Members 19*a* and 19*b* are formed so that flow channel 31 with an outwardly increasing width is formed between walls 29 and 30. Nozzle 19 is therefore of the so-called De Laval design which efficiently utilizes the energy in the pressure gas and gives the gas jet a very high velocity and a high energy content. Member 19*b* in nozzle 19 may be vertically displaceable in relation to the member 19*a* so that the width of the channel can be varied. It can be seen that a downwardly sloping V-shaped indentation 25 is located in the top surface of first member 19*a*.

Figure 9:
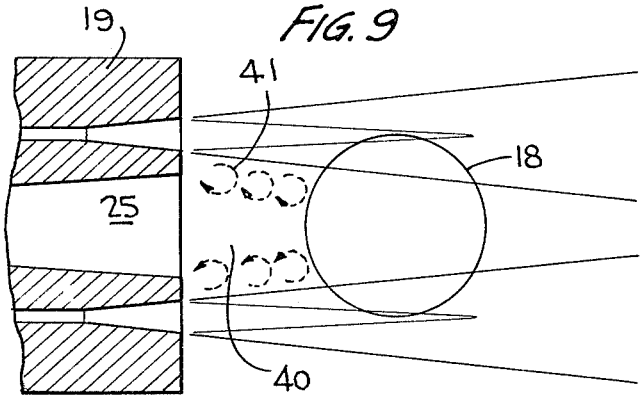
FIG. 9 depicts, on an enlarged scale, a sectional view along line D—D of FIG. 3, showing the potential eddy flows of molten metal droplets when an auxiliary gas jet is not utilized in association with the trough-shaped gas jet emitted from the primary nozzle.

Secondary nozzle 20 supplies gas to the indentation 25 near the orifice of nozzle 19 so that the negative pressure caused by the ejector effect is eliminated and the metal droplets from stream 18 are prevented from eddying towards the orifice of the nozzle 19 in the fashion suggested in FIG. 9. In this manner, the metal droplets from tap stream 18 are prevented from coming into contact with nozzle 19 and being deposited at the opening of the nozzle and unfavorably influencing the shape characteristics of the nozzle, or completely clogging the nozzle. The cleaning effect of the auxiliary gas jet 26 from secondary nozzle 20 thus allows the primary nozzle 19 to be located nearer tap stream 18 and thus less energy is lost in from the V-shaped gas jet 22 before the V-shaped gas jet hits the side of tap stream 18. For example, with a tap stream having a diameter of 6 mm, the nozzle 19 can be as close as 10 mm from the side of the tap stream. Consequently, better atomization of the metal can be obtained, which will, upon cooling, yield a better metal powder having a reduced quantity of coarse powder grains (which otherwise would have to be separated out). A corresponding supply of gas at the other sides of nozzle 19 may also be favorable.

The auxiliary gas jet 26 from secondary nozzle 20 also has another important effect. By altering the pressure of the supplied gas and thus the velocity and the amount of gas in the auxiliary gas jet 26, together with the velocity and amount of gas in the V-shaped gas jet, the trajectory of the formed powder can be influenced so that the trajectory acquires a suitable shape relative to the shape of collecting section 3, thereby influencing the time it takes the formed powder to reach the bottom of section 3 and thus the degree to which the powder grains will be cooled when they are caused to come in contact with one another. This will thus influence the degree to which the powder grains will possibly stick together.

Figure 5:
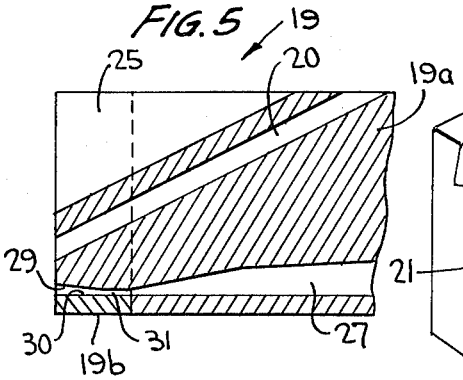
FIG. 5 shows a sectional view through a portion of a composite nozzle which can be used in the apparatus of FIG. 1 instead of the two separate nozzles shown in FIG. 4.

As shown in FIG. 5, nozzles 19 and 20 can be combined into a composite nozzle 19'. Nozzle 19' is constructed to include a first member **19*a*' and a second member 19*b*', which elements correspond with first and second members 19*a* and 19*b* of the nozzle 19 in FIG. 4, first member 19*a*' including a flow channel 27' and, together with the second member 19*b*', defining a flow channel 31' with walls 29' and 30' (similarly to flow channel 27, flow channel 31 and walls 29 and 30 in FIG. 4); in addition, first member 19*a*' includes an upper flow channel 20' which is equivalent to the flow channel defined by nozzle 20 in FIG. 4. An indentation 25' is formed in the top surface of first member 19*a*' similarly to indentation 25 in the first member 19*a* in FIG. 4**.

Figure 6:
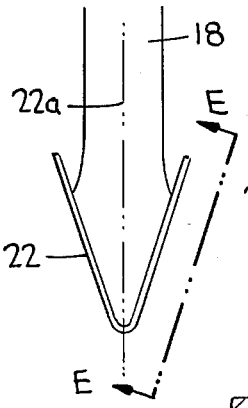
FIG. 6 shows a view along line B—B of FIG. 2, depicting the orientation of the trough-shaped gas jet emitted from the primary nozzle with respect to the cross section of the vertically descending stream of molten metal.

FIG. 6 clearly shows that the V-shaped gas jet will have a very great effective width relative to tap stream 18 and that the axis of symmetry **22*a* will preferably be aligned with the vertical center line 18*a* of the tap stream 18**.

Figure 7:
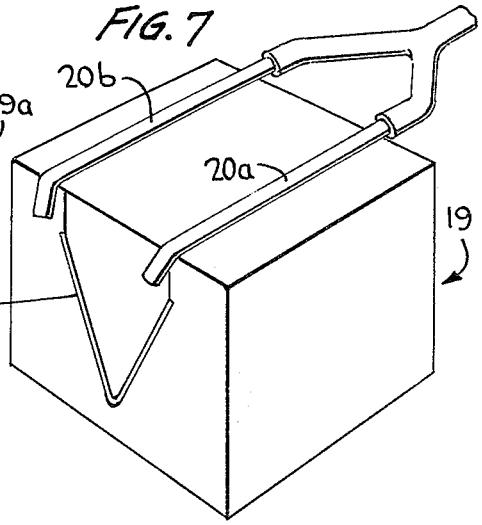
FIG. 7 shows a prespective view of an alternative nozzle combination which can be used in the apparatus of FIG. 1 instead of the two nozzles shown in FIGS. 3 and 4 or the composite nozzle shown in FIG. 5.

As shown in FIG. 7, the nozzle 19 as shown in FIGS. 3 and 4 can be replaced with a nozzle 40 which is composed of a first member 41 and a second member 42. The first member 41 does not include any indentation in its upper surface similar to indentation 25 in nozzle 19, while the second member 42 is movable with respect to first member 41 via bolts 28'. Furthermore, the secondary nozzle 20 as shown in FIGS. 3 and 4 can be replaced with twin nozzles **20*a* and 20*b* which will direct auxiliary gas jets downwardly towards one another, yet away from the front face 40*a* of the nozzle 40. The secondary nozzles 20*a*, 20*b* will produce gas flows which will, regardless of how many are used, act to eliminate the eddy whirls 51 which will form in the open space 50 in the V-shaped gas jet if the auxiliary gas jets are not utilized (see FIG. 9**).

Figure 8:
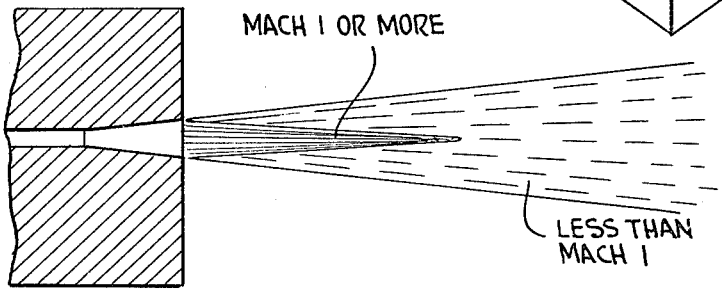
FIG. 8 depicts, on an enlarged scale, a sectional side view of the zones of the gas jet emitted from the lowermost portion of the primary nozzle shown in FIG. 4 which flow at a velocity in excess of Mach 1.

It should be noted that the nozzles depicted in FIGS. 8 and 9, representing sections through the nozzle 19 of FIG. 3, are of the convergent-divergent De Laval type.

One side contact surface formed between the tap stream and the V-shaped gas jet (as seen along line E—E in FIG. 6) is shown in FIG. 10.

If the tap stream 18 has a circular cross section, the contact surface between the tap stream and the V-shaped gas jet will have a semi-elliptical shape (see FIG. 10). It is desirable that as close to uniform conditions as possible exist over the contact surface where the gas jet hits the tap stream. This can to a great extent be achieved by modifying the contact surface, either by modifying the shape of the tap stream of molten metal, or by modifying the characteristics of the nozzle and thus the gas jet. This modifying of the nozzle can be carried out either by changing the channel form of the gas jet, or by having a nozzle opening with a varying opening width along its inclining legs, thereby varying the gas jet energy in relation to the width l of the contact surface. This last-mentioned method is the most practical one.

In operation of the apparatus, the shape of the V-shaped gas jet makes it possible to break up tap stream 18 with a smaller amount of gas than in previosuly known methods and jet shapes. The energy consumption for the gas compression is therefore considerably reduced, and of course the size of the cleaners (not shown) used in cleaning the gas taken from housing 1 is also reduced. Since the amount of gas required for solidification of the formed droplets into solid powder is greater than the amount of gas which is consumed by nozzles 19 and 20, a certain portion of the quantity of gas which is taken out from collecting section 3 through cooler 11 is returned without cleaning to granulating section 2 of housing 1 through ducts 12, 13, 14, 15 and 16. As is apparent from FIG. 1, nozzles 19, 20 will be located in the current of cooling air. With a suitable location of nozzle 19 in granulating section 2 and a suitable shape of its cross-section, a considerable driving force for the cooling air current can be obtained. This ejector effect, either alone or in combination with a fan (not shown), is able to cause the circulation of the gas required for the cooling of the droplets and the powder.

By the present invention, it has become possible to construct a granulating apparatus with a relatively small height since a single trough-shaped gas jet can cause a tap stream to be directly broken up into droplets which will form a powder of a practical size. Some previously used efficient granulating apparatus using a gas as the granulating medium have required cooling towers with a height of six meters or more. Such a relative large height for the apparatus has necessitated particularly high buildings to house the apparatus and corresponding high costs as well as expensive means for the vertical transportation of raw materials from melting furnaces or of molten metal. In contrast, the granulating apparatus used to achieve the method according to the present invention can be contained in a housing having a height of only about three meters which may provide considerable savings in the construction of a new building to house the apparatus. Perhaps more importantly, the apparatus in general can be installed in an existing building of steelworks and melting plants and the means of transportation available therein can be easily utilized which thereby results in considerably lower costs when changing to powder manufacture according to the invention.

While the present invention has been described with reference to particular embodiments thereof, it will be understood that numerous modifications may be made by those skilled in the art without actually departing from the spirit and scope of the invention as defined in the appended claims.

We claim:

1. A method of forming a metal powder which includes (a) forming a vertically downwardly moving tap stream of molten metal, (b) directing a trough-shaped first jet of gas towards the side of said stream so as to impact therewith and generate droplets of molten metal and thereafter cause the droplets to be thrown in a substantially parabolic trajectory, said trough-shaped jet of gas having an open top and a vertically oriented plane of symmetry therethrough, said plane of symmetry of said trough-shaped jet intersecting said stream, (c) directing a second jet of gas obliquely downwardly towards the open top of said trough-shaped first jet of gas so as to prevent molten metal droplets from moving in a second jet of gas having the same general direction of flow as said trough-shaped first jet of gas, and (d) rapidly cooling the droplets of molten metal to form the metal powder as said droplets travel in said substantially parabolic trajectory.

2. A method according to claim 1 wherein said trough-shaped first jet of gas is directed such that the angle ($\alpha$) between the direction of flow of said trough-shaped first jet of gas and the direction of flow of the tap stream is between 45° and 135°.

3. A method according to claim 2 wherein said angle ($\alpha$) is between 60° and 100°.

4. A method according to claim 3 wherein said angle of ($\alpha$) is 90°.

5. A method according to claim 2 wherein the downwardly moving tap stream has a vertical center line therethrough, and wherein said vertical plane of symmetry of said trough-shaped first jet of gas is aligned with the vertical center line of said tap stream.

6. A method according to claim 5 wherein said second gas jet is directed so that it impinges the tap stream ahead of the point of impact of the bottom portion of the trough-shaped first jet of gas.

7. A method according to claim 2 wherein said second gas jet is directed substantially towards the location where the bottom portion of the trough-shaped first jet of gas impinges against said tap stream.

8. A method according to claim 2 wherein the flow rates of said trough-shaped first jet of gas and said second gas jet are varied so as to adjust the parabolic trajectory of the droplets of molten metal.

9. A method according to claim 8 wherein said trough-shaped first jet of gas and said second jet of gas flow through respective nozzles and wherein said flow rates thereof are varied by controlling the pressure of the gases fed to the respective nozzles.

10. A method according to claim 1 including the steps of collecting the gas from the jets, then cooling, cleaning and compressing a first portion of the collected gas and supplying said first portion of collected gas to the nozzles, and cooling and circulating a second portion of the collected gas for removal of heat.

11. A method according to claim 1 wherein said trough-shaped first jet of gas has a V-shaped cross-section.

12. A method according to claim 1 wherein two second jets of gas are directed obliquely downwardly towards the open top of said trough-shaped jet of gas, said two second jets of gas having substantially the same direction of flow as said trough-shaped jet of gas.

13. A method according to claim 1 wherein in step (d) the droplets of molten metal are rapidly cooled by a contact with a stream of cooling gas.

* * * * *

UNITED STATES PATENT AND TRADEMARK OFFICE

CERTIFICATE OF CORRECTION

PATENT NO. : 4,382,903

DATED : May 10, 1983

INVENTOR(S) : Hans G. Larsson and Erik Westman

It is certified that error appears in the above–identified patent and that said Letters Patent are hereby corrected as shown below:

On the title page Insert:

[30] FOREIGN APPLICATION PRIORITY DATA

July 21, 1978 [SE] Sweden.....7808028

Signed and Sealed this

Thirtieth Day of August 1983

[SEAL]

*Attest:*

GERALD J. MOSSINGHOFF

*Attesting Officer*

*Commissioner of Patents and Trademarks*